US008474483B2

(12) United States Patent
Komurian et al.

(10) Patent No.: US 8,474,483 B2
(45) Date of Patent: Jul. 2, 2013

(54) VALVE UNIT WITH A SLIDING THROTTLE-CHAMBER AND CIRCUIT COMPRISING A VALVE

(75) Inventors: Richard Komurian, Turckheim (FR); Julien Peuch, Orbey (FR); Nicolas Becker, Colmar (FR); Hugues Winkelmuller, Colmar (FR); Alexandre Floranc, Sainte-Croix-en-Plaine (FR)

(73) Assignee: Systemes Moteurs (SAS) (FR)

( * ) Notice: Subject to any disclaimer, the term of this patent is extended or adjusted under 35 U.S.C. 154(b) by 1091 days.

(21) Appl. No.: 11/860,408

(22) Filed: Sep. 24, 2007

(65) Prior Publication Data

US 2008/0111092 A1 May 15, 2008

(30) Foreign Application Priority Data

Sep. 25, 2006 (FR) ..... 06 08388

(51) Int. Cl.
*F16K 11/12* (2006.01)
*F16K 11/16* (2006.01)
*F16K 3/26* (2006.01)

(52) U.S. Cl.
USPC ..... 137/625.13; 137/625.11

(58) Field of Classification Search
USPC ..... 137/625.11, 627.5, 628, 630.12, 137/630.13, 630.16, 630.19, 630.22, 827.5, 137/862, 871, 872, 877, 883, 625.12, 625.13; 236/93 A, 99 J, 99 K, 101 C
See application file for complete search history.

(56) References Cited

U.S. PATENT DOCUMENTS

| | | | | |
|---|---|---|---|---|
| 2,314,512 | A | 3/1943 | Parker | |
| 2,983,286 | A | 5/1961 | Greenawalt et al. | |
| 3,945,401 | A * | 3/1976 | Greenwood | 137/627.5 |
| 4,027,474 | A * | 6/1977 | Demase | 60/39.281 |
| 4,488,680 | A | 12/1984 | Itoh | |
| 6,748,977 | B2 * | 6/2004 | Berto | 137/628 |
| 2005/0252462 | A1 * | 11/2005 | Guyon et al. | 123/41.1 |

FOREIGN PATENT DOCUMENTS

| | | |
|---|---|---|
| DE | 20021258 | 7/2001 |
| FR | 623231 | 6/1927 |
| FR | 2868811 | 10/2005 |
| JP | 58-149668 | 10/1983 |

OTHER PUBLICATIONS

European Search Report for corresponding European Patent Application No. 07117205.0, mailed Feb. 4, 2008, 7 pages.
Search Report for French Patent Application No. 0608388, completed May 18, 2007, 2 pages.

* cited by examiner

*Primary Examiner* — John Rivell
*Assistant Examiner* — Jonathan Waddy
(74) *Attorney, Agent, or Firm* — Sheridan Ross PC

(57) ABSTRACT

Valve unit with a sliding throttle-chamber, comprising a valve body with an exchange or distribution chamber adapted to receive a sliding throttle-chamber of which the position of translation in the chamber defines ways of fluid communication between a primary inlet opening and at least two secondary outlet openings that can be selectively blocked or released by said throttle-chamber; the sliding throttle-chamber has a composite structure and consists of a first part controlling the fluid communication of said, at least, one secondary or radial outlet opening with the chamber and a second part controlling the fluid communication of the secondary or axial outlet opening with the chamber, the two parts of the throttle-chamber being linked together by a driving link in translation with a dead or non-driving area between the two extreme translation positions of said throttle-chamber.

12 Claims, 15 Drawing Sheets

VALVE UNIT WITH A SLIDING THROTTLE-CHAMBER AND CIRCUIT COMPRISING A VALVE

CROSS REFERENCE TO RELATED APPLICATION

The present application claims the benefit of French Patent Application Serial No. 0608388, filed Sep. 25, 2006, which is incorporated herein by this reference.

The present invention concerns the field of controlling and checking the circulation of fluid, in particular of liquid, but also of gaseous fluid, particularly cooling liquid, in a complex circuit, for example with a plurality of partially parallel and mutually overlapping or interconnected loops, having common portions, such as the coolant circulation circuits of motor-vehicle internal combustion engines.

The present invention relates, in the above-mentioned context, to a valve unit with a sliding throttle-chamber, regulating at least two outlets, and a cooling circuit having such a valve unit.

BACKGROUND OF THE INVENTION

In view of the need to reduce manufacturing costs, space occupied and total weight, which is particularly pressing in the field of motorcar manufacture, there is strong demand to reduce the number of fluid-circulation adjustment and control elements in complex circuits and if possible to incorporate all the adjustment and control functions in one operational and structural assembly, operated by one actuator, thus producing one adjustment unit for a plurality of circuit portions of the same general circuit.

Another possible way of reducing costs consists in fitting actuators that are cheap to manufacture and therefore uncomplicated and of a simple structure.

A twofold problem therefore emerges, namely, that of spatially connecting the various circuit portions inside the unit (problem of overall size) and that of achieving different adjustments for the various circuit portions while respecting their hierarchy and the conditions whereby they are achieved, based on the general adjustment within the circuit as a whole.

The above-mentioned problems arise principally with regard to the adjustment, by means of a structural device or single module, of the circulation of coolant within a circuit comprising a main portion and at least two, preferably three, secondary portions, namely, for example, not only the circuit running through the engine block, but also a loop passing through a radiator, a loop passing through a unit heater, and possibly a by-pass loop.

The problem facing the present invention therefore basically consists in providing a multi-way adjustment device that requires only a simple means of actuation, for example by translation, comprising only one adjustment element and enabling connections in at least two perpendicular directions.

SUMMARY OF THE INVENTION

For this purpose, the present invention relates to a valve unit with a sliding throttle-chamber, comprising a valve body with an exchange or distribution chamber which is at least partly shaped and adapted to receive a sliding throttle-chamber that can be moved in a guided manner in the direction of shaped extension of said chamber and the position of translation of which in the chamber, between two extreme positions, defines ways of fluid communication between a primary or fluid inlet opening and at least two secondary or fluid outlet openings that can be selectively blocked and released by said throttle-chamber, a secondary or outlet opening opening axially into said chamber and the, at least, two other openings opening radially therein, by being angularly offset in relation to each other around the median axis and/or axis of symmetry of said chamber, corresponding to the direction of translation of the throttle-chamber or direction of shaped extension of the chamber, valve unit characterised in that the sliding throttle-chamber has a composite structure and consists of a first part controlling the fluid communication of said, at least, one secondary or radial outlet opening with the chamber and of a second part controlling the fluid communication of the secondary or axial outlet opening with the chamber and in that the two parts of the throttle-chamber are linked together by a driving link in translation with a dead or non-driving area between the two extreme translation positions of said throttle-chamber.

BRIEF DESCRIPTION OF THE DRAWINGS

A better understanding of the invention will be facilitated by the following description which relates to a preferred embodiment, given by way of a non-limiting example and explained with reference to the appended schematic drawings, in which.

DETAILED DESCRIPTION OF THE INVENTION

Figure 1A:
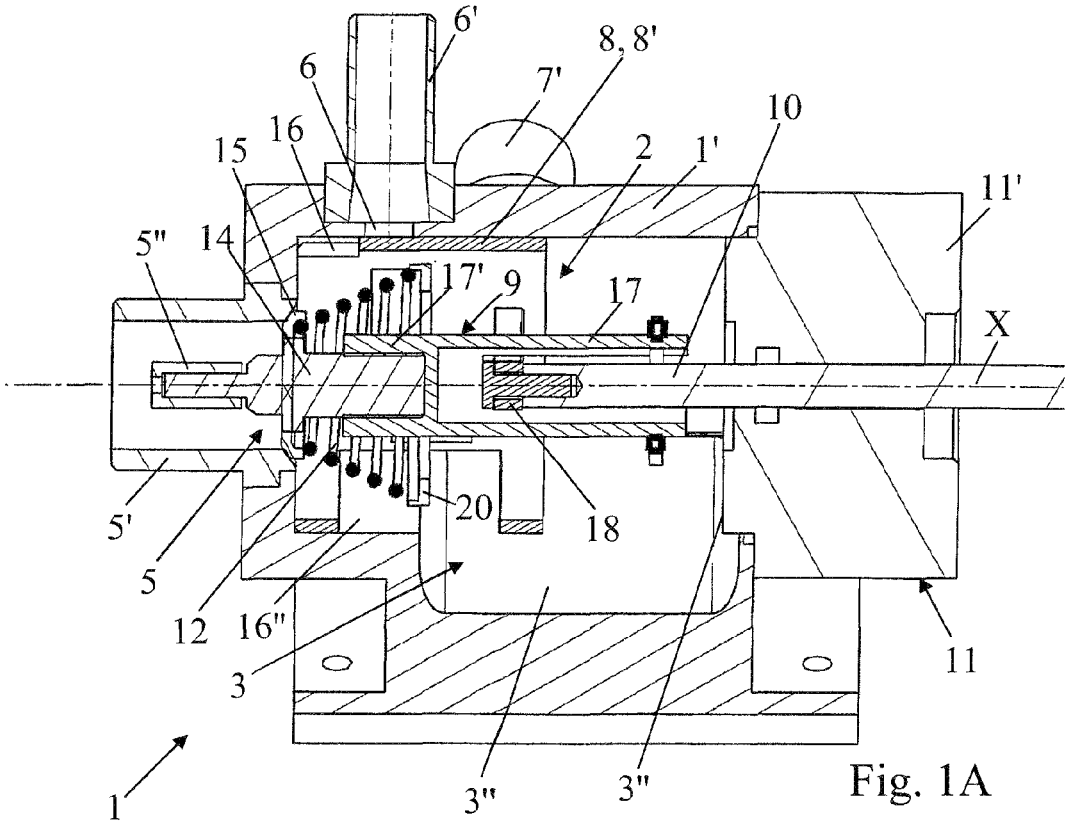
FIGS. 1A, 1B, 1C and 1D are cross-sections along a plane containing the axis of translation of the sliding throttle-chamber, of a valve unit according to the invention, illustrating four different translation positions of said throttle-chamber.
Figure 1B:
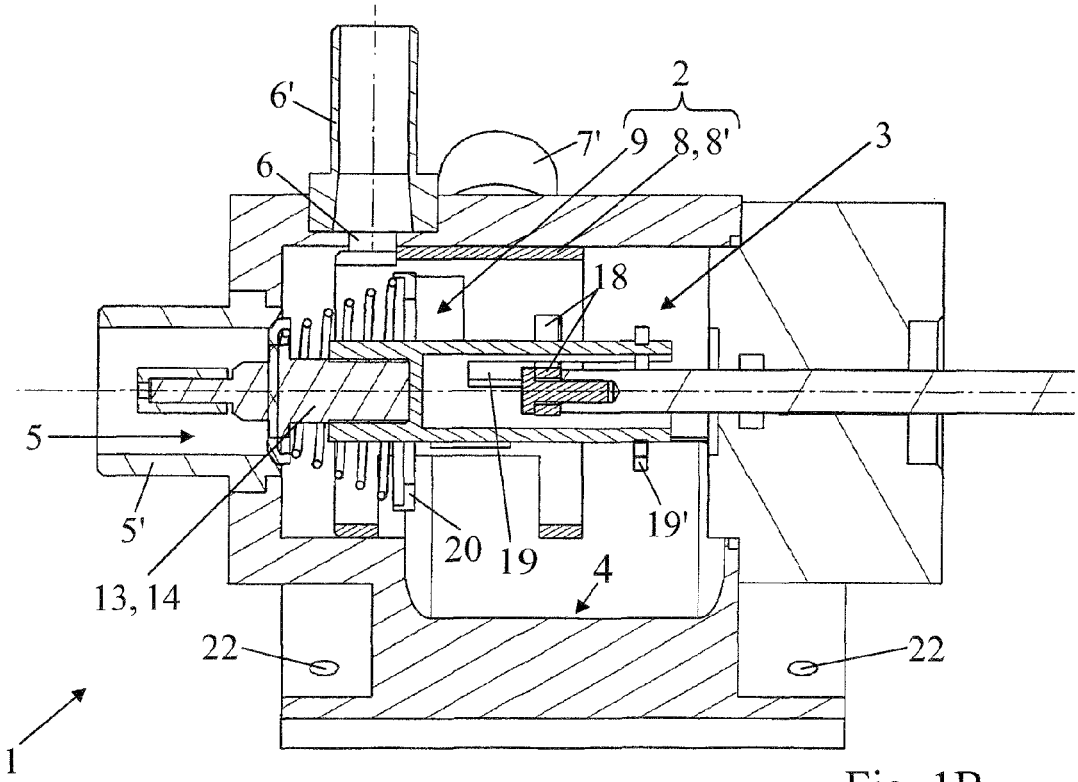
Figure 1C:
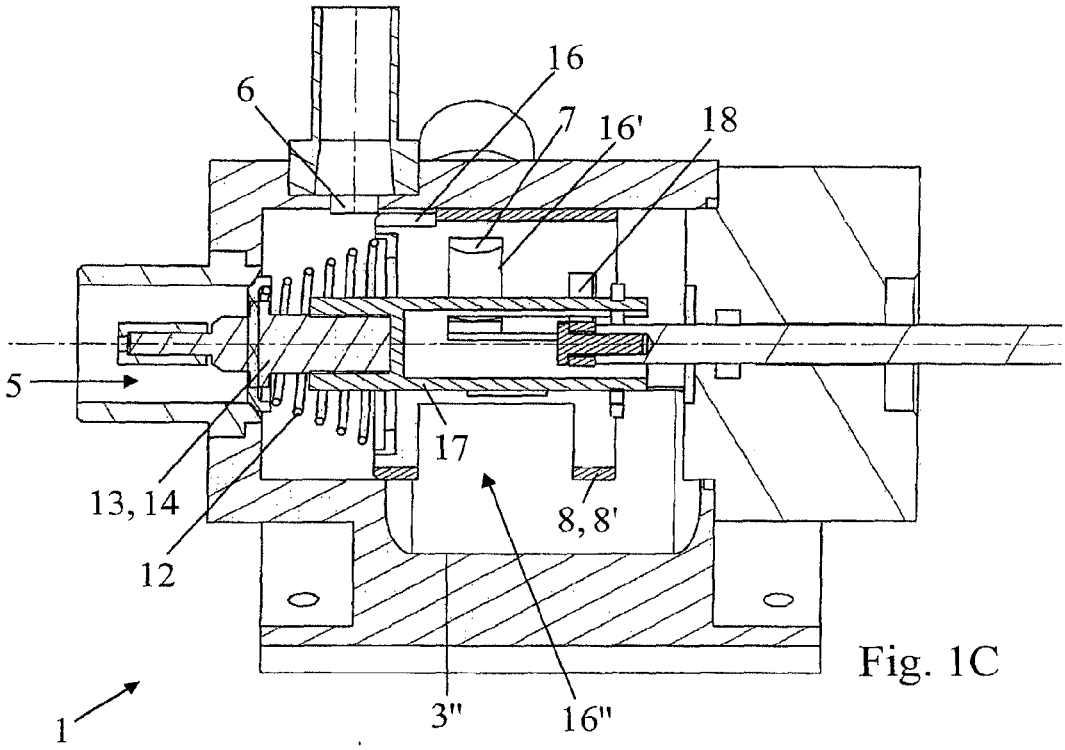
Figure 1D:
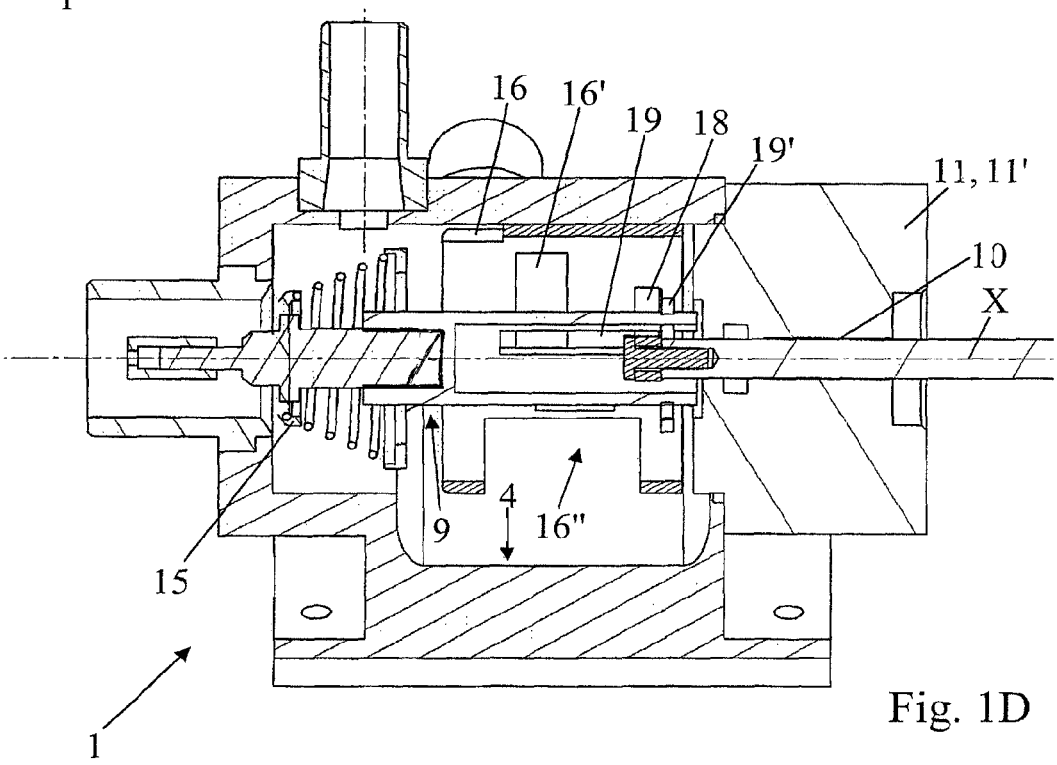
Figure 2A:
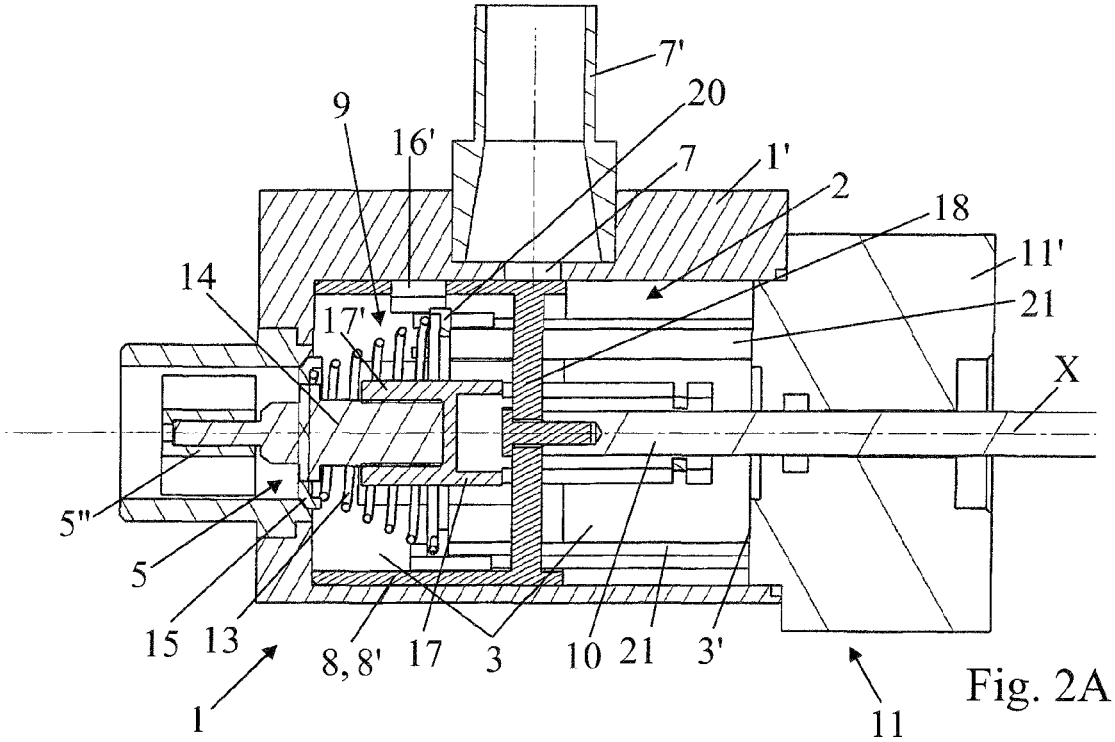
FIGS. 2A, 2B, 2C and 2D are similar views to those shown in FIGS. 1A, 1B, 1C and 1D respectively, along another plane containing the axis of translation of the sliding throttle-chamber.
Figure 2B:
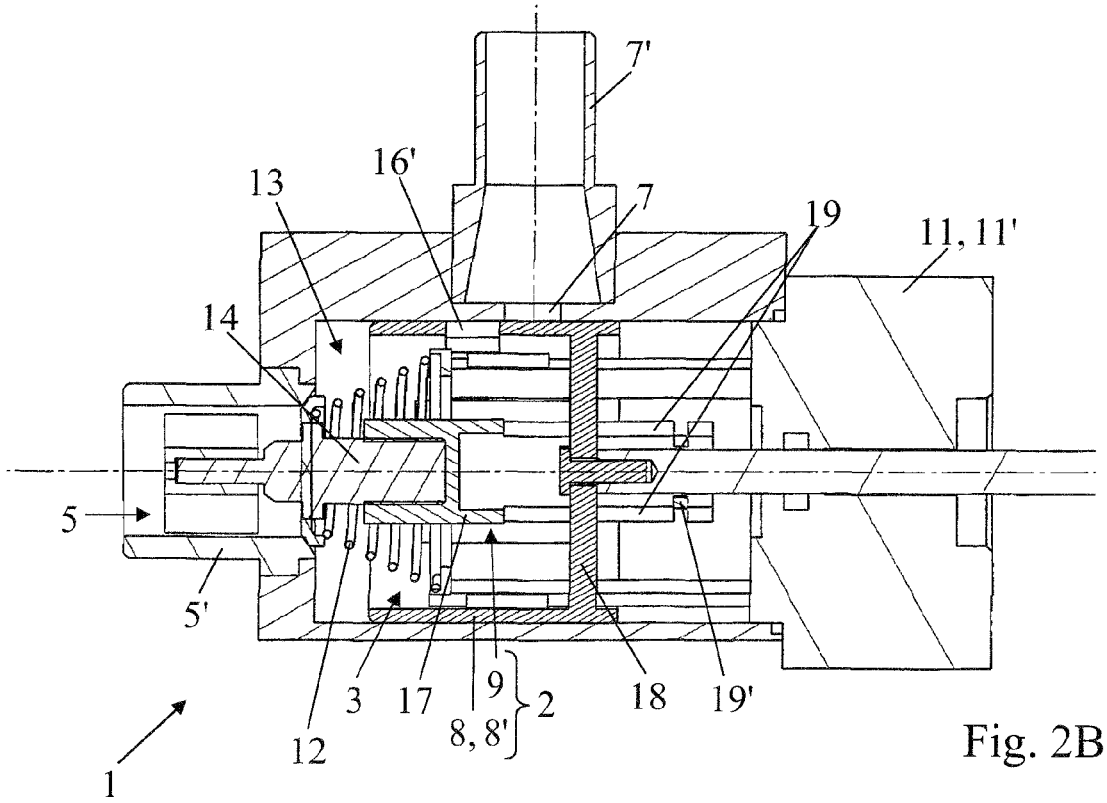
Figure 2C:
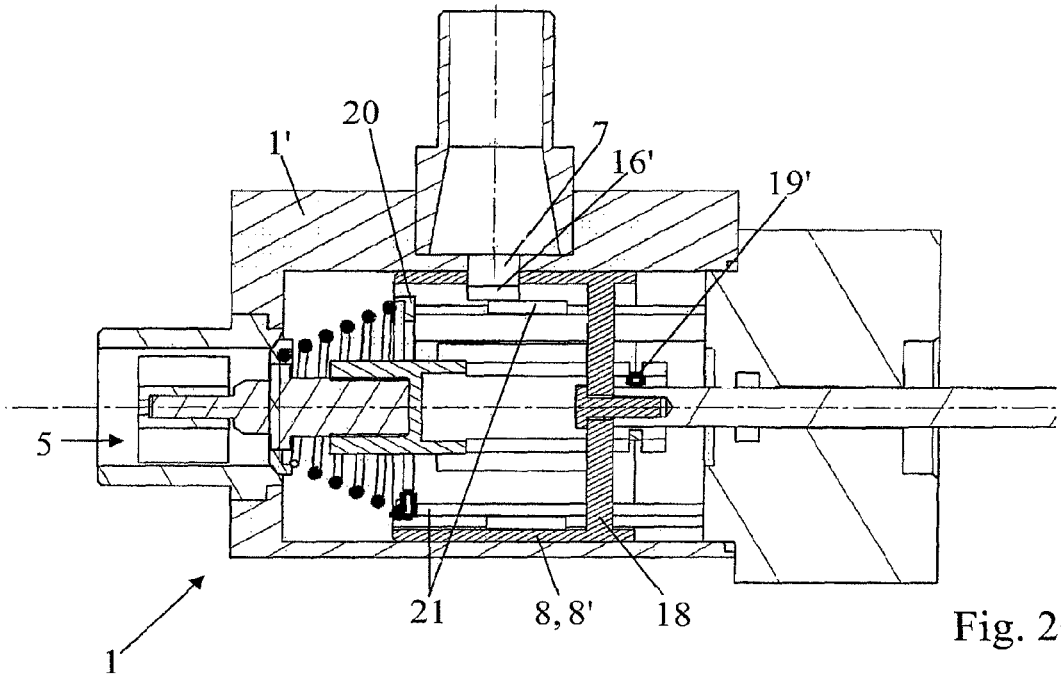
Figure 2D:
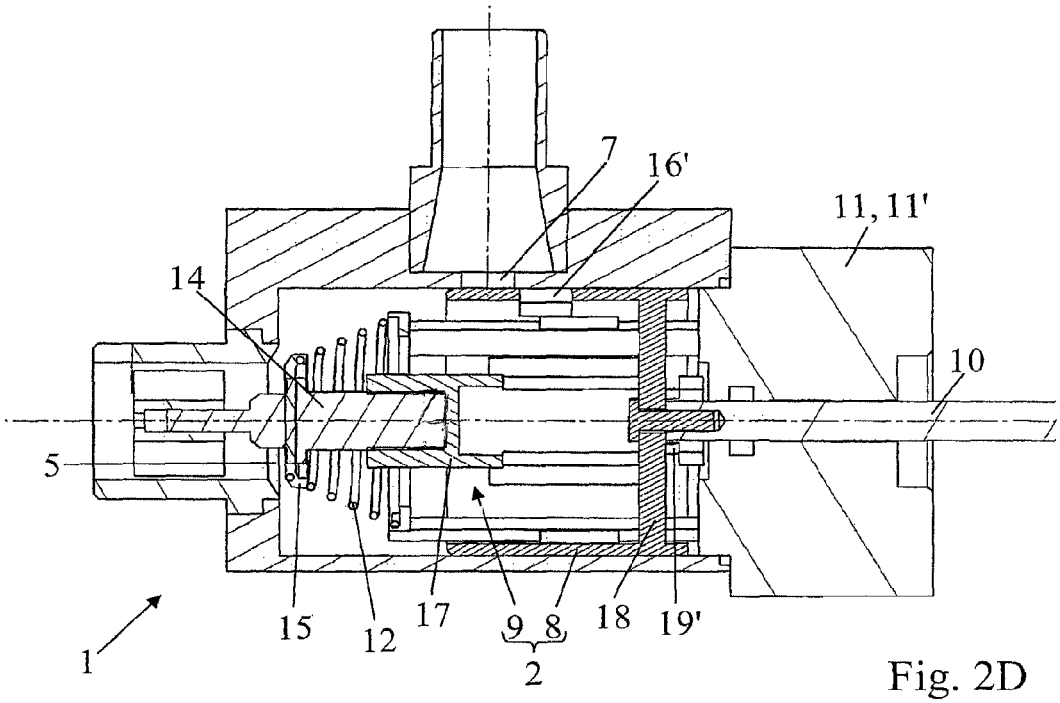
Figure 3:
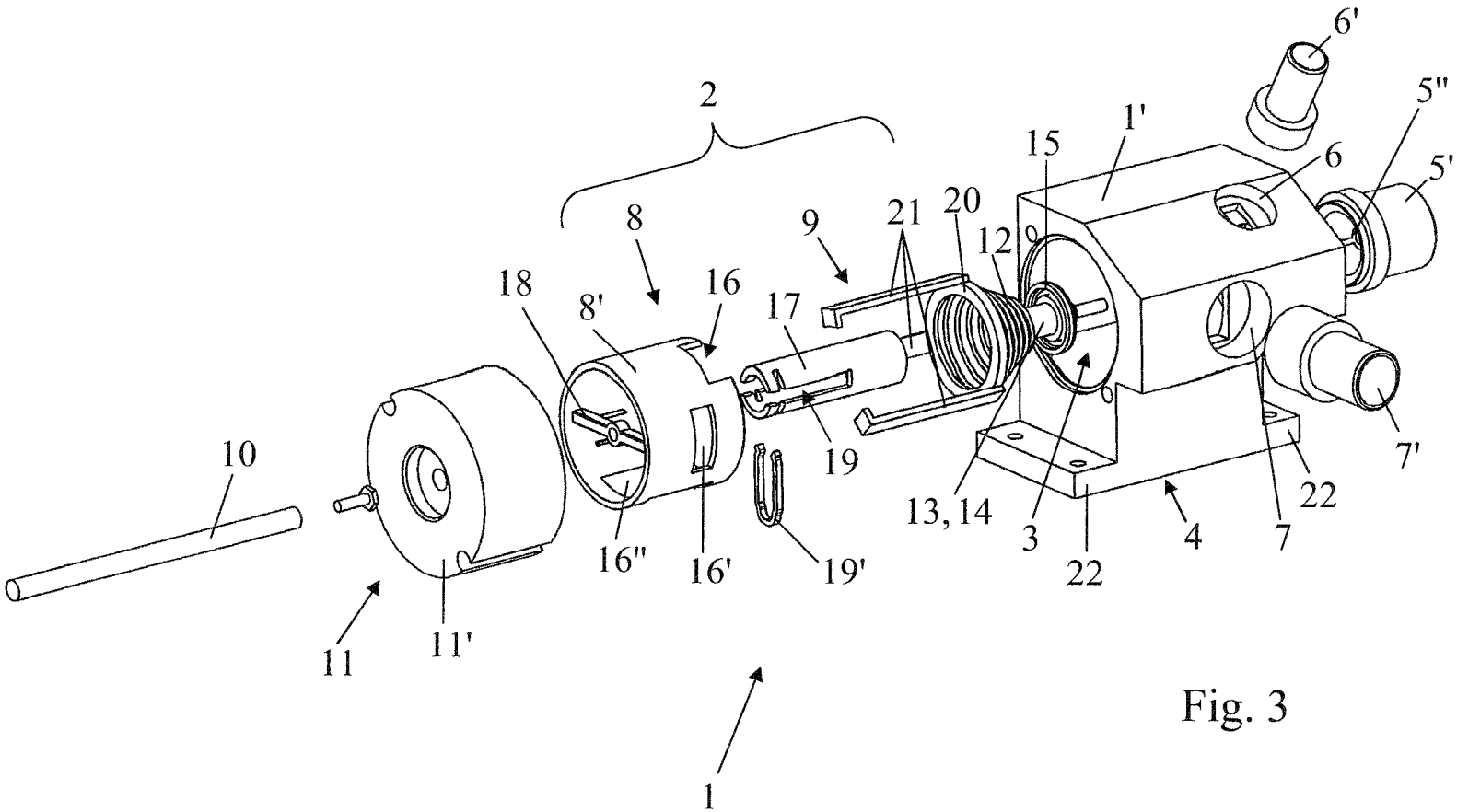
FIG. 3 is an exploded perspective view of the valve unit shown in FIGS. 1 and 2.
Figure 4:
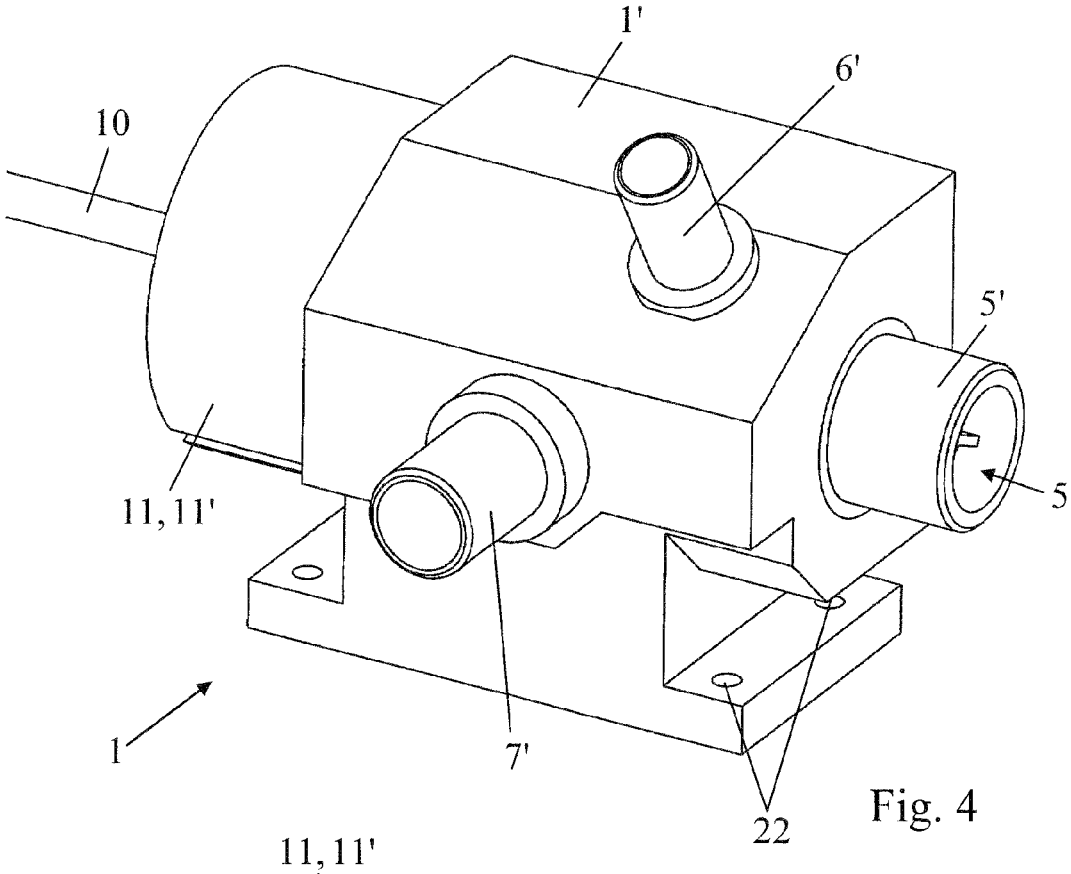
FIG. 4 is a perspective view in the assembled state of the valve shown in FIG. 3.
Figure 5:
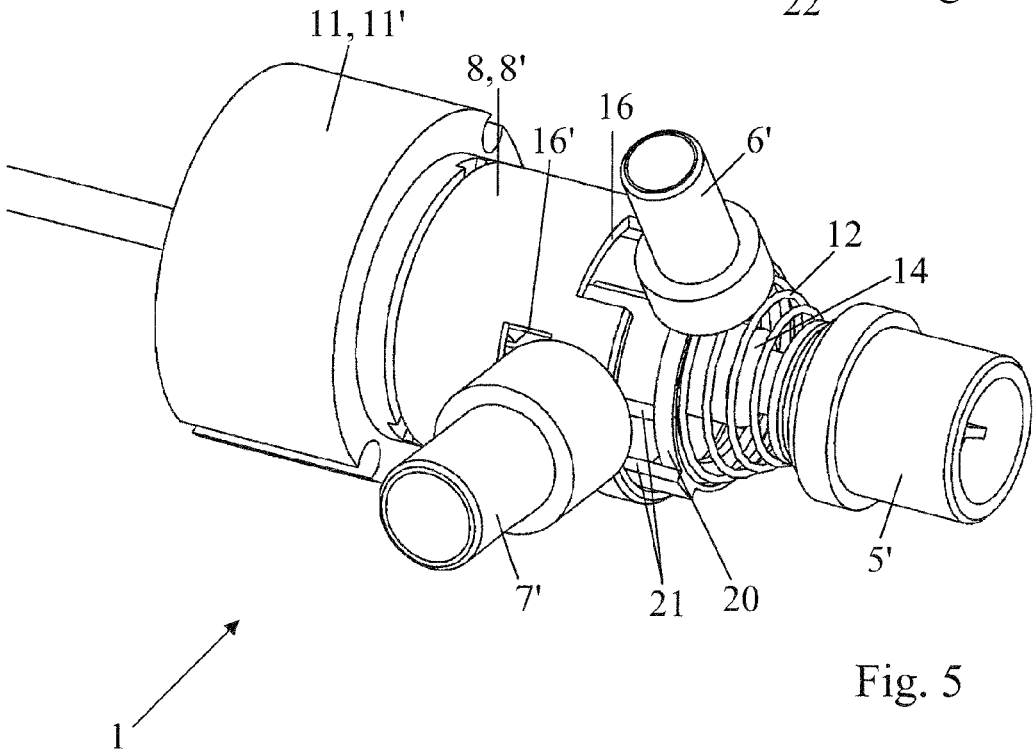
FIG. 5 is a cutaway view through the body of the valve of the valve unit shown in FIG. 4, and FIGS. 6A, 6B and 6C are views from below (FIG. 6A) and in perspective respectively showing the primary or inlet opening, the sliding throttle-chamber being substantially in a position similar to that shown in FIGS. 1D and 2D.
Figure 6A:
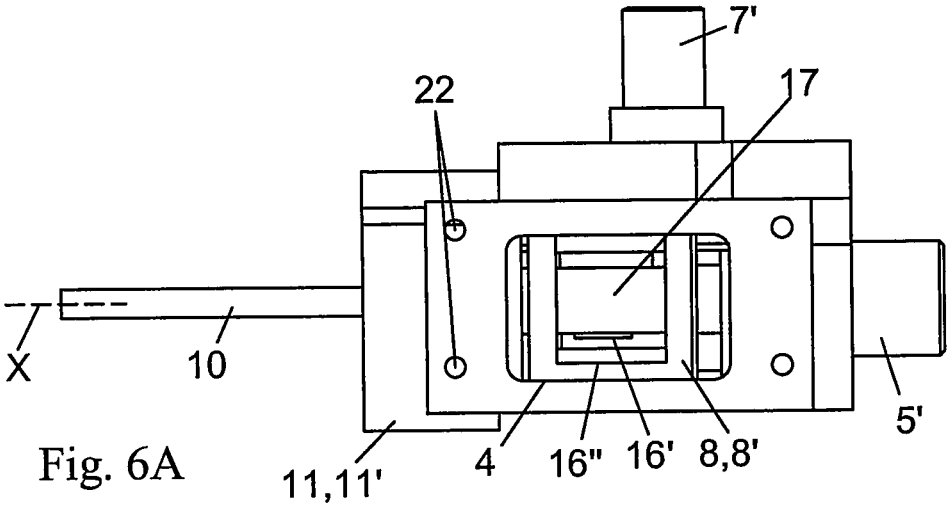
Figure 6B:
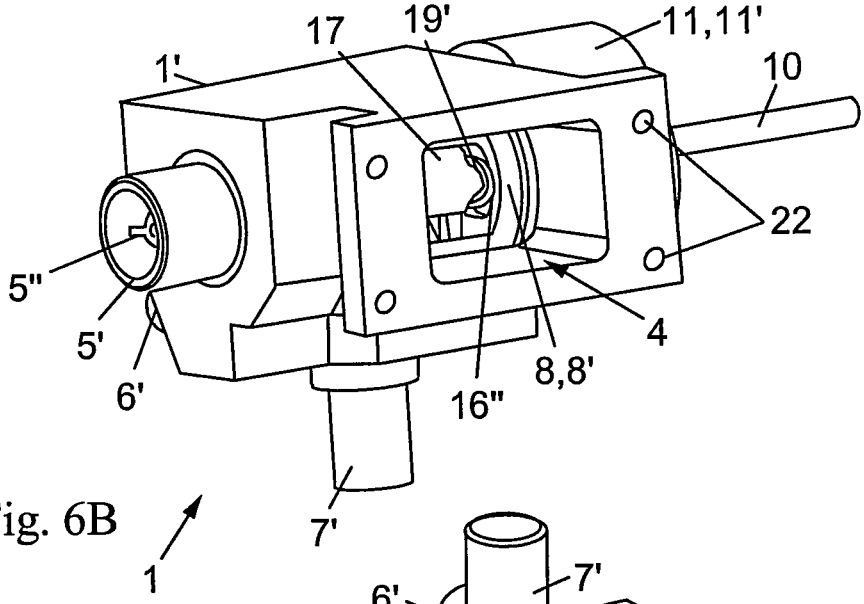
Figure 6C:
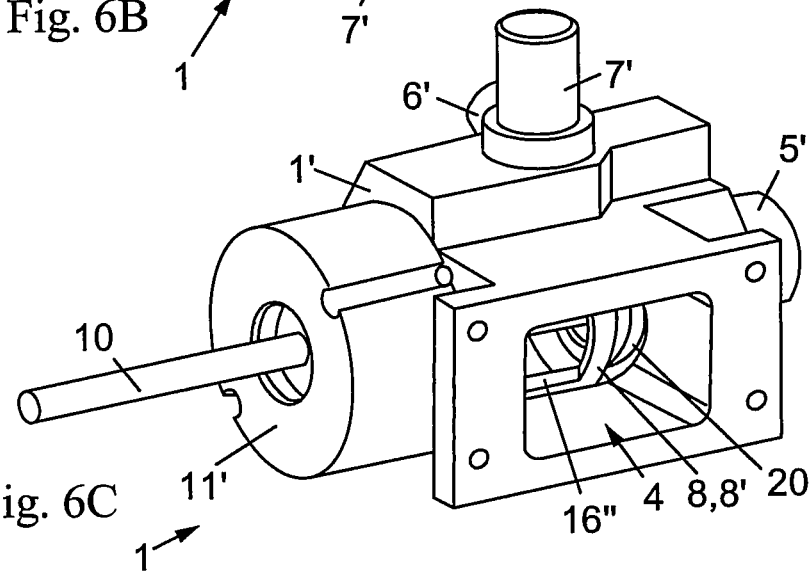
Figure 8A:
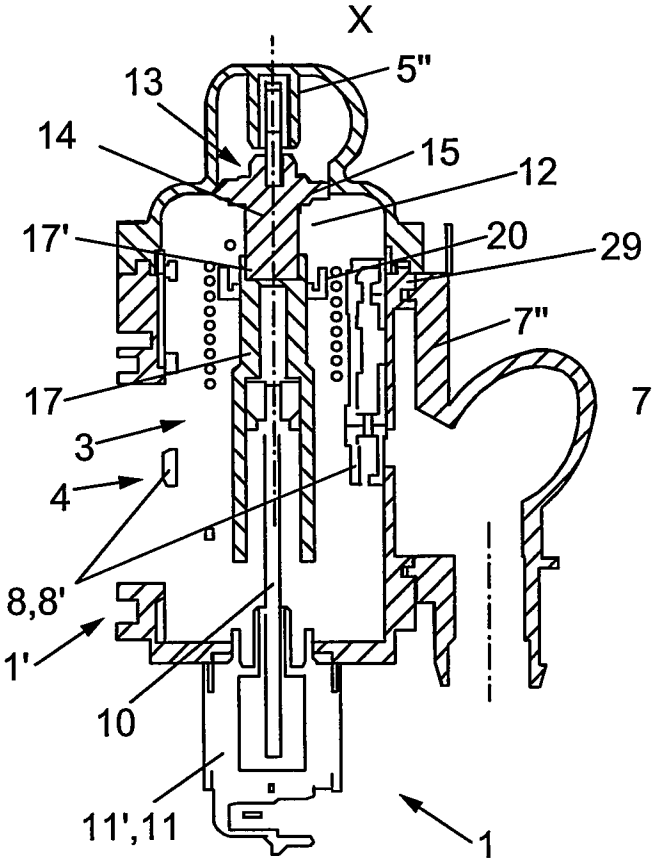
FIGS. 8A, 8B, 8C and 8D are cross-sections similar to those shown in FIGS. 7A, 7B, 7C and 7D respectively (same positions of the throttle-chamber), along another plane containing the axis of translation of the sliding throttle-chamber.
Figure 7A:
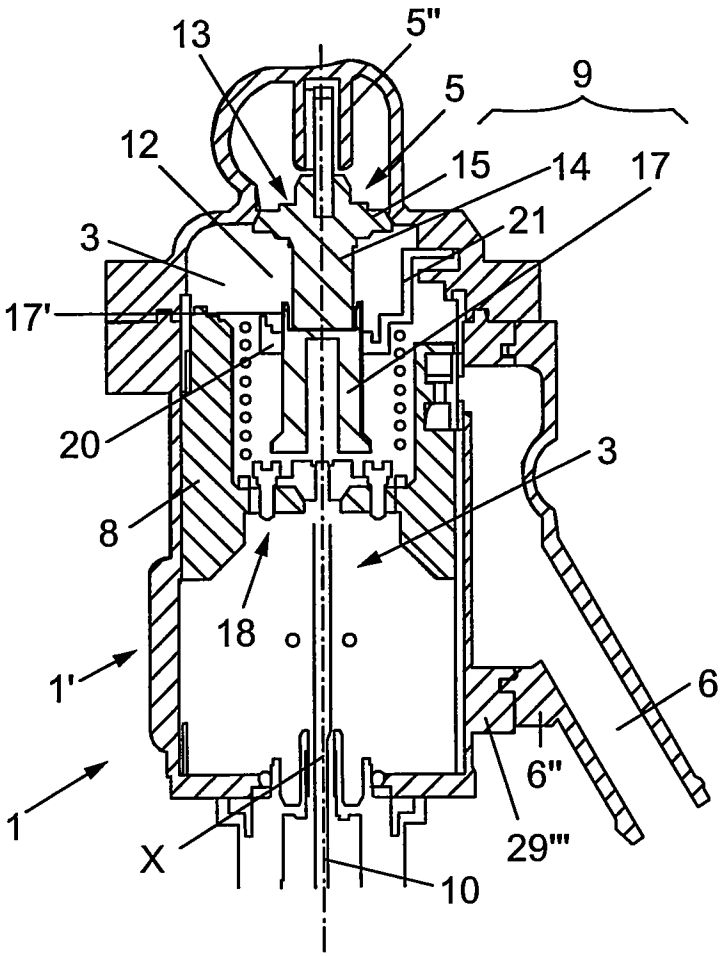
FIGS. 7A, 7B, 7C and 7D are cross-sections along a plane containing the axis of translation of the sliding throttle-chamber, of a valve unit according to a variation of the invention, illustrating four different translation positions of said throttle-chamber.
Figure 8B:
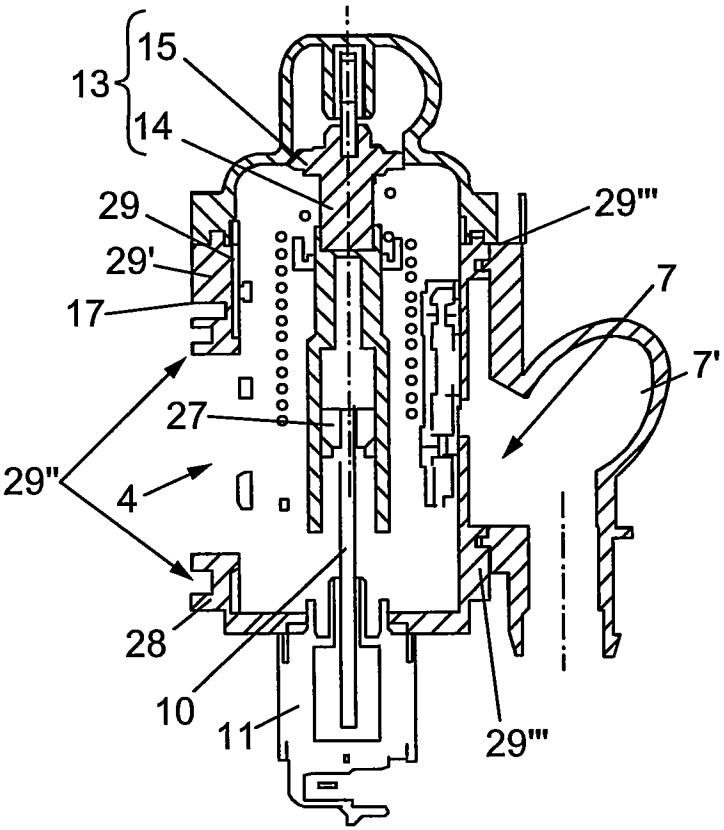
Figure 7B:
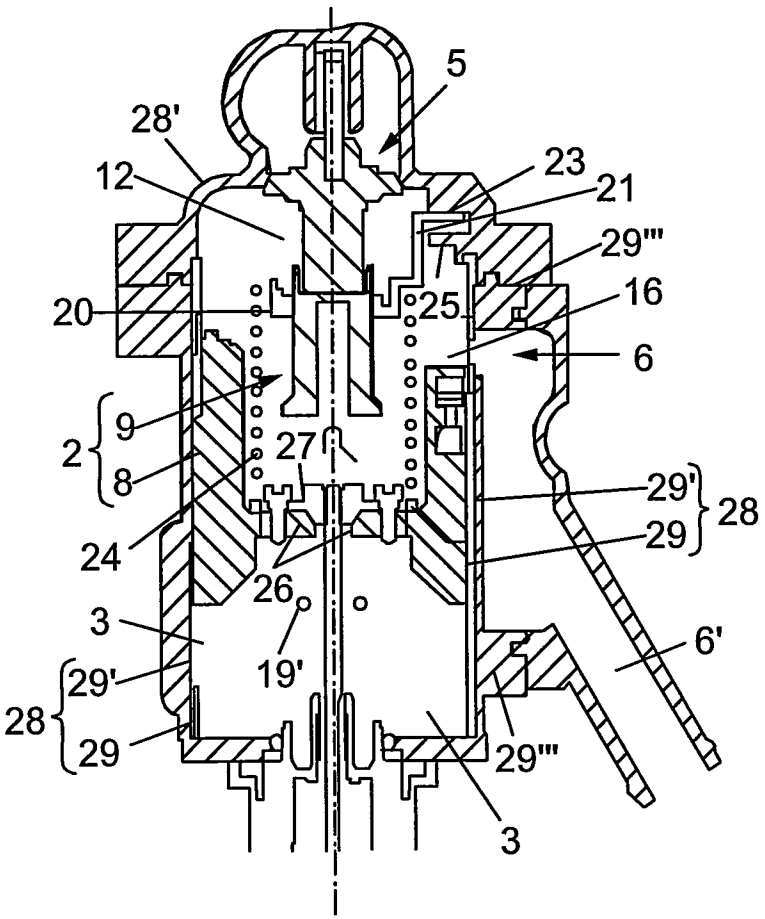
Figure 8C:
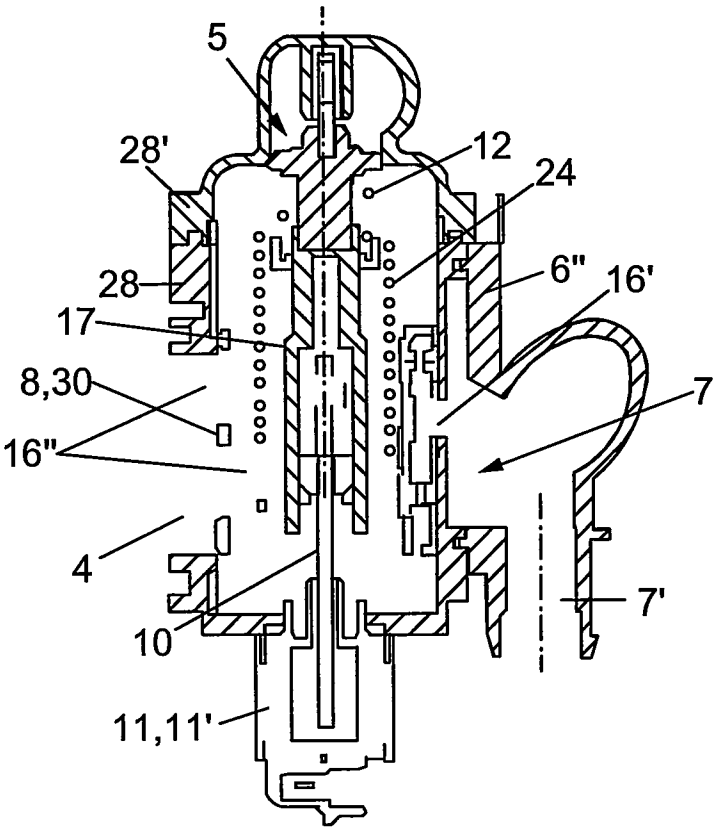
Figure 7C:
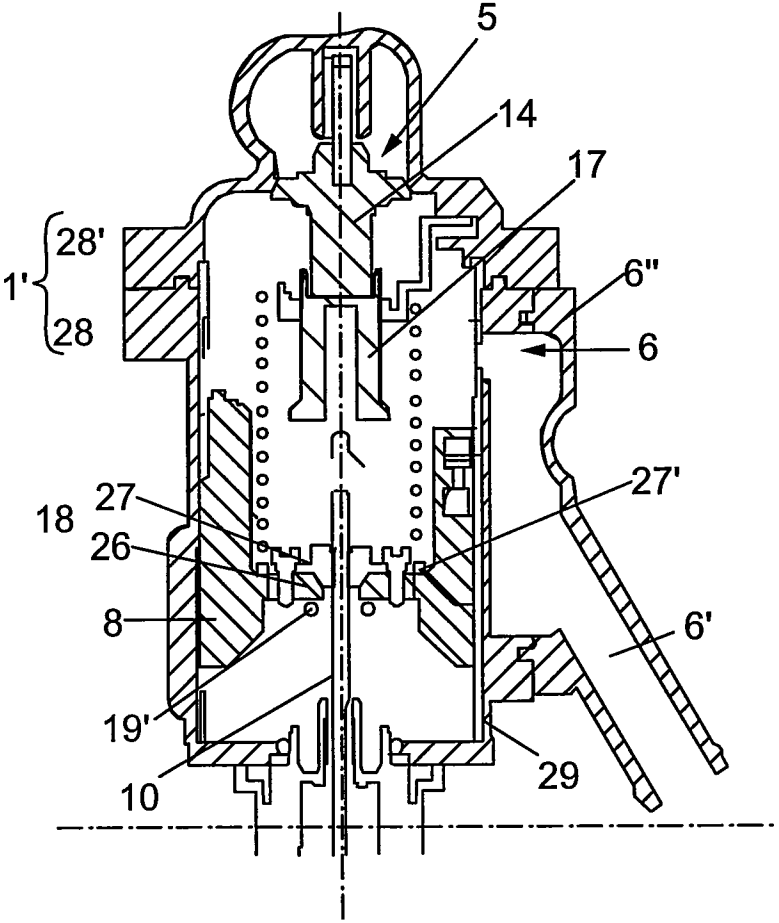
Figure 8D:
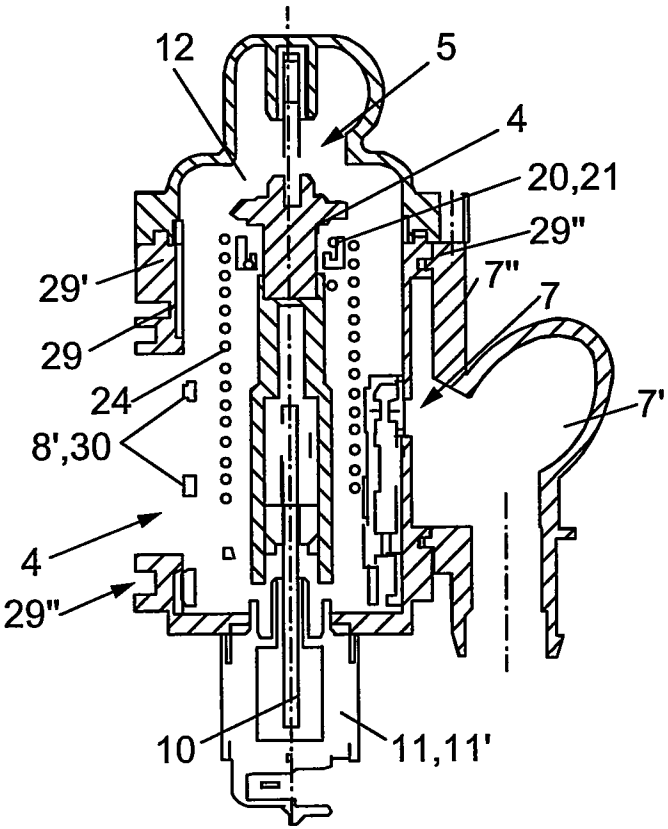
Figure 7D:
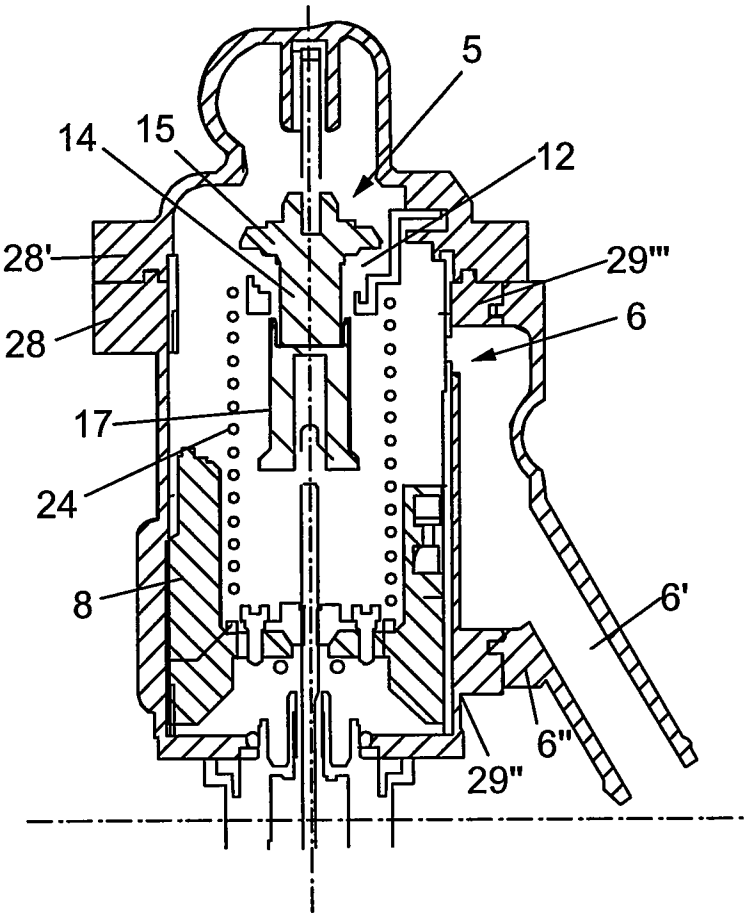

The accompanying drawings in FIGS. 1 to 12 show a multi-way valve unit 1 with a sliding throttle-chamber 2.

This valve unit 1 comprises a valve body 1' with an exchange or distribution chamber 3 at least partially shaped, adapted to receive a sliding throttle-chamber 2 capable of being moved in a guided manner in the direction of shaped extension X of said chamber (defining an axial direction) and of which the position in translation in the chamber 3 defines the fluid communication ways between a primary or fluid inlet opening 4 and at least two secondary or fluid outlet openings 5, 6, 7 that can be selectively blocked and released by said throttle-chamber.

A secondary or outlet opening 5 opens axially into said chamber 3 and the other at least two openings 6, 7 open radially, therein, being offset at angles in relation to each other around the median axis and/or axis of symmetry x of said chamber, corresponding to the direction X of translation or direction of shaped extension of the chamber 3 (at least for that part of the volume of chamber 3 covered by the throttle-chamber between its extreme positions).

According to the invention, the sliding throttle-chamber 2 has a composite structure and consists of a first part 8 controlling the fluid communication of said, at least, one secondary or radial outlet opening 6, 7, with the chamber 3 and of a second part 9 controlling the fluid communication of the secondary or axial outlet opening 5 with the chamber 3, the two parts 8 and 9 of the throttle-chamber 2 being connected together by a translation driving link with a dead or non-driving area between the two extreme translation positions of said throttle-chamber 2.

Owing to the above-mentioned arrangements, it is possible, with one operational element moved by a simple movement in translation, to control the circulation of liquid or gaseous fluid through at least two openings 5, 6, 7, facing in diverging directions and distributed over a plurality of sides of the valve body 1', notably with a secondary opening 5 facing the direction of translation X (positioned axially) and the other secondary opening or openings 6, 7 being substantially perpendicular to this direction X (positioned radially).

Moreover, the non-driving area allows the state of release of the secondary axial opening 5 to be changed in relation to changes in the states of release of the secondary radial opening or openings 6, 7 along the length of the possible translation travel of the sliding throttle-chamber 2.

Each of the loops or circulation circuit portions connected to one of the secondary openings 5, 6, 7, will be able to have a special function or be connected to an element or module that fulfils a specific function, contributing to the general operation of the whole circulation circuit containing the valve unit 1. Thus, when taking into account the role to be played by each of the loops or circuit portions, as well as their spatial arrangement, it will be necessary to choose for each one the secondary opening 5, 6, 7 to which it will be connected, as well as the way in which the two parts of the throttle-chamber 8 and 9 control the flows passing through these openings and co-operate with each other with regard to the movement in translation of said throttle-chamber 2.

Although the present invention can apply fully in the case of two-way valves (that is, with two outlet or secondary openings 5 and 6), it can apply even more advantageously when producing valves with at least three ways, and in this latter case, the valve body 1' has at least three secondary or outlet openings 5, 6, 7, namely an axial secondary opening 5 and at least two radial secondary openings 6, 7, the latter being, if necessary, offset at angles and axially in relation to each other.

Furthermore, in order to ensure a permanent supply to the chamber 3, whatever the state of valve 1, the first part 8 thereof is advantageously arranged so that the inlet opening 4 is in fluid communication with the chamber 3, whatever the translation position of said throttle-chamber 2.

According to a preferred embodiment of the invention, shown in FIGS. 1 and 2, and in FIGS. 7 and 8, the valve unit 1 forms a two- or three-way valve (that is, with two or three secondary or outlet openings) and the movement in translation of the throttle-chamber 2 from one extreme position to the other, starting from the extreme position corresponding to a total blocking of the two or three secondary or outlet openings 5, 6, 7 (FIGS. 1A and 2A or 7A and 8A), defines, taking into account the configuration and co-operation of the two parts 8 and 9 of the throttle-chamber 2 between each other and with the chamber 3 of the valve body 1', the following sequence of different states of fluid communication:

- release of the or a first secondary or radial outlet opening 6 (FIGS. 1B and 2B or 7B and 8B);
- release, if necessary, of the second secondary or radial outlet opening 7, the first radial opening 6 remaining free (FIGS. 1C and 2C or 7C and 8C);
- release of the secondary or axial outlet opening 5, if necessary, while keeping the radial opening or at least one of the two radial openings 6, 7 released (FIGS. 1D and 2D or 7E and 8D).

In this preferred variation, the non-driving area is used to defer the release of the secondary opening 5 at the end of travel of the sliding throttle-chamber 2.

According to another characteristic of the invention, also shown in FIGS. 1 and 2, as well as in FIGS. 7 and 8, in the case of a three-way valve, the first part 8 of the throttle-chamber 2 may be designed so that on the release of the secondary or axial outlet opening 5, the first secondary radial opening 6 stays released and the second secondary radial opening 7 is blocked.

According to a possible embodiment of the invention that enables, for example, an operating sequence as previously described based on the movement of the throttle-chamber 2, an arrangement may be made whereby only the first part 8 of the sliding throttle-chamber 2 is connected to an actuating means 10, 11 to cause its movement in translation, whereby the second part 9 of the sliding throttle-chamber 2 is loaded, for example by a resilient means 12, towards a position of blocking the secondary or axial outlet opening 5 and whereby when the throttle-chamber 2 moves in translation, starting from the extreme position corresponding to a blocking of the two or three secondary or outlet openings 5, 6, 7, only the first part 8 is actually moved in translation during a first driving stage corresponding to the dead or non-driving area of the connection between the two parts 8 and 9, the second part 9 not being moved in translation in order to release the secondary or axial outlet opening 5, against the above-mentioned load, except during a second stage of driving and movement in translation of the first part 8, corresponding to a positive driving engagement between the two parts 8 and 9.

Furthermore, when the loop or circuit portion connected to the secondary axial opening 5 is a back-up or positive safety circuit for the entire circuit incorporating the valve unit, the second part 9 of the sliding throttle-chamber 2 may have a thermal safety device 13, the sensitive part of which 14 is in contact with the fluid in the chamber 3 and which is capable of releasing the secondary or axial outlet opening 5, if necessary against a normal load when the blocking element 15 of the second part 9 closes and possibly also by moving the latter.

Dispensing with the safety function (default state or position) of the actuator 11 allows simple and inexpensive actuators to be used.

According to a practical embodiment of the invention, having a three-way valve structure (that is with three outlet or secondary openings 5, 6 and 7), the first part 8 of the sliding throttle-chamber 2 basically has the form of a hollow cylindrical sleeve, the constituent wall of which 8' has, on the one hand, an external shape adapted to slide at least partially guided inside the chamber 3 of the valve body 1' between two extreme near and far positions from the secondary or axial outlet opening 5 and, on the other hand, cut-outs 16, 16' which can be brought opposite one of the two secondary or radial outlet openings 6 and 7 during the movement in translation of the first part 8 of the sliding throttle-chamber 2 between the two extreme positions, successively defining a plurality of states of fluid communication with the exchange chamber 3.

The shape, dimensions and arrangement of the cut-outs 16 and 16' depend on the desired sequence of the states of fluid communication.

Thus, said cut-outs 16, 16' may have either a contour that corresponds exactly to the contour of the opening 6, 7 to which they are respectively associated (totally releasing the corresponding opening in one precise position of the first part 8), or a smaller contour than that of the associated opening (resulting in at most a partial release of the corresponding opening), or even a contour with a rectangular shape elongate in the direction of translation X or of the axis of symmetry of the sleeve 8', having the same or shorter length than the diameter of the associated opening, or having a variable width (controlled and preset variation of the section of released passage of the associated opening depending on the degree of movement of the first part 8).

The cut-out 16" of the sleeve 8' designed to face the primary or inlet opening 4 will be of sufficient width and length for this opening 4 to be permanently released for the most part. It will therefore extend along most of the length of the sleeve 8' and will be at least the same width as the transverse dimension of the opening 4.

According to another characteristic of the above-described practical variation and as is also shown in the accompanying drawings, the second part 9 of the sliding throttle-chamber 2 basically comprises a blocking element 15 either indirectly or directly mounted on an elongate driving element 17 connected operationally, by a translation drive link with a dead or non-driving area, to the first part 8 of said throttle-chamber 2, a resilient means 12 pushing the blocking element 15 in a closed position of the secondary or axial outlet opening 5, in the direction of translation X of said sliding throttle-chamber 2 and said elongate drive element 17 extending into the first part 8 of the throttle-chamber 2 in the form of a hollow sleeve.

In order to create the drive link between the first and second parts 8 and 9 of the sliding throttle-chamber 2 in a simple manner, the hollow cylindrical sleeve 8' forming the body of the first part 8 of the throttle-chamber 2 may, for example, have a cross-piece 18 connected to a control rod 10 which can be moved in translation by an actuator 11 and the elongate drive element 17 of the second part 9 of the throttle-chamber 2, having a hollow cylindrical structure for example, may have a longitudinally extended through-slot that receives, with a possibility of limited free sliding, the above-mentioned cross-piece 18, said limited free sliding travel defining the dead or non-driving area of the drive link existing between the first and second parts 8, 9 of the throttle-chamber 2.

If the elongate element 17 is in the form of a hollow body, in particular with a cylindrical structure, the through-slot 19 is in the form of two opposing cut-outs in the form of slots made in the wall of said hollow body.

Moreover, so that the cross-piece 18, either formed or not formed in one piece with the wall of the sleeve 8', can be fitted easily into said slot 19, the longitudinal cut-outs forming the latter by co-operation may emerge at the trailing end of the elongate element 17 (the end opposite portion 17'), the slot 19 being delimited in this direction by a clip 19' or a similar inserted piece forming a stop for the cross-piece 18.

Advantageously, the resilient means 12 pushing the blocking element 15 of the second part 9 of the throttle-chamber 2 into a closed position consists of a compression spring mounted on a support ring 20 located opposite the secondary or axial outlet opening 5 and held by a support structure 21, for example in the form of arms.

According to a first constructional variation, shown in FIGS. 1 to 6, these arms (21) can rest on the wall 3' of the chamber 3 opposite the secondary or axial outlet opening 5, the supporting ring 20 and its supporting structure 21 extending between the elongate drive element 17 and the wall 8' of the hollow sleeve forming the body of the first part 8 of the sliding throttle-chamber 2.

According to a second constructional variation, shown in FIGS. 7 to 12, said ring 20 and said arms 21 can together form a stirrup resting on the valve body 1' in the region of the opening 5 and extending around the second part 9 of the sliding throttle-chamber 2.

Figure 9:
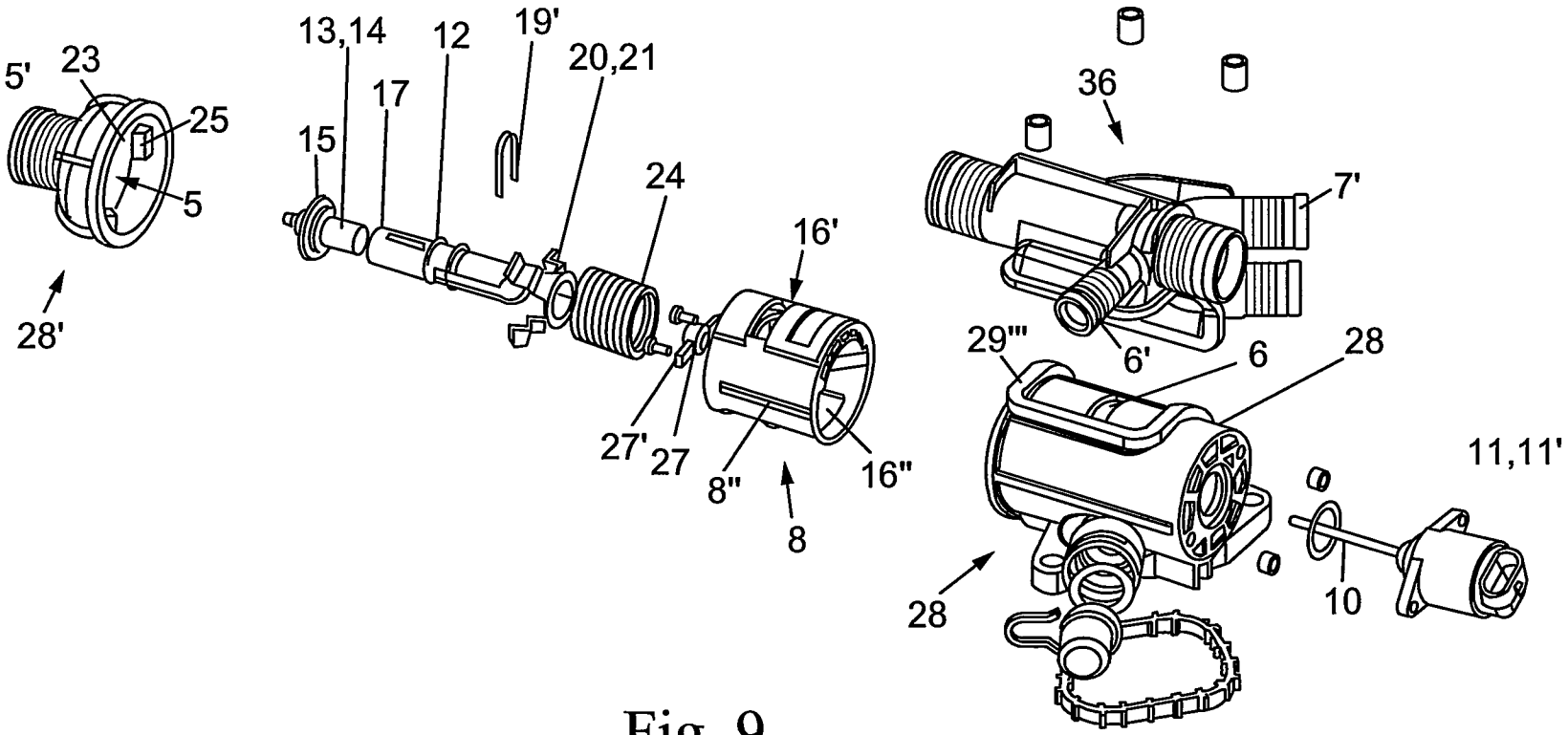
FIG. 9 is an exploded perspective view of a valve unit as shown in FIGS. 7 and 8, with a complex piece incorporating the end-pieces of the first and second radial openings.
Figure 10A:
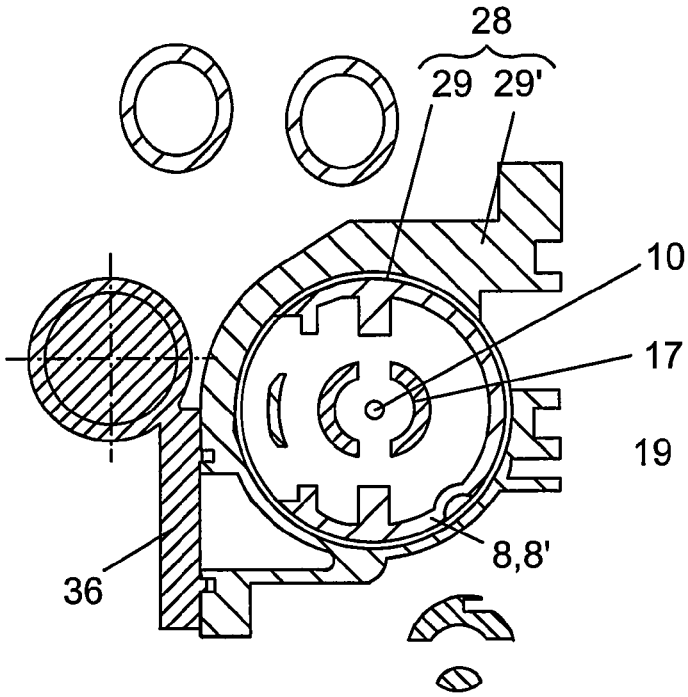
FIGS. 10A and 10B are offset cross-sections along a plane perpendicular to the axis of translation of the throttle-chamber, illustrating in particular a possible composite composition of the first constituent part of the valve body forming part of the valve unit in FIGS. 7 to 9.
Figure 10B:
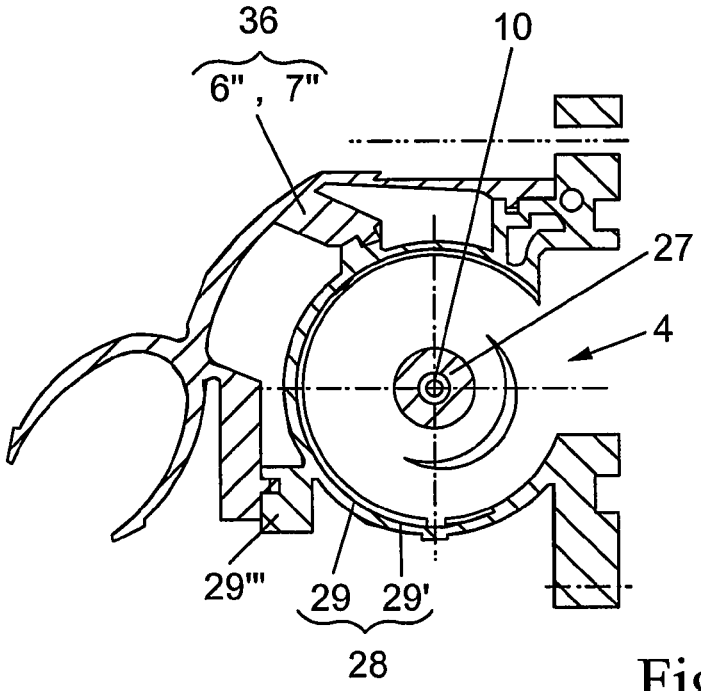

As is shown in FIGS. 7 and 9 in particular, the arms 21 of the stirrup thus rest on the internal surface portions 23 of the wall of the valve body 1' located around the axial opening 5 and a second compression spring 24 is mounted so as to rest under stress, for the one part, on the ring 20 or the arms 21 of the stirrup and, for the other part, on the cross-piece 18 of the body 8' of the first part of the throttle-chamber 2, the axial thrust provided by said second spring 24 through the stirrup being greater than the opposing axial thrust delivered by the first spring 12, so that the ends of the arms 21 of said stirrup rest against the internal surface portions 23, whatever the axial translation position of the body 8' of the first part 8 of the throttle-chamber 2 in the valve body 1'.

Moreover, this second compression spring 24, by preloading, can limit the force to be provided by the actuator 11 to move the throttle-chamber 2 into its position shown in FIGS. 1D, 2D, 7D and 8D (release of axial opening 5), so that an actuator 11 which provides a substantially unidirectional force can be chosen.

According to another characteristic of the invention, the valve body 1' may have on its internal face, in the region of the surface portions 23, protuberant formations 25 forming with said surface portions 23 reception points for the ends of the arms 21 of the stirrup, resembling a bayonet fitting, and the cross-piece 18 of the body 8' of the first part 8 of the throttle-chamber 2 may consist of two opposing projections 26 formed on the internal face of the wall of said first part 8 to which is affixed a nut 27 fitted with fastening arms 27', said nut 27 co-operating with the control rod 10 produced in the form of a threaded screw, and the first part 8 of the throttle-chamber 2 being guided whilst sliding into the valve body 1' and locked in rotation around the axis of sliding X, for example by co-operation of longitudinal ribs 8" of the first part 8 with the internal grooves of the valve body 1' (FIGS. 7 to 9).

To make it easier to create the valve body 1' and fit the sliding throttle-chamber 2 into the internal exchange chamber 3 formed in said body, the latter may have, as is shown in FIGS. 1 to 6, an exchange chamber 3 which is open on the side opposite the wall supporting the secondary or axial outlet opening 5, said open side being blocked tightly by the casing 11' of an actuator 11 allowing the movement in translation of the sliding throttle-chamber 2 by means of a control rod 10.

Furthermore, said chamber 3 advantageously has a lateral recess 3" forming a radial volume extension where the primary or inlet opening 4 emerges into said chamber 3.

According to another characteristic of the invention, the thermal safety device 13 preferably consists of a wax cartridge module 14, bearing the blocking element 15 of the second part 9 of the sliding throttle-chamber 2 and fitted in a front portion 17' of the elongate drive element 17, said module 13 being designed to move the blocking element 15 out of its closed position, against the load exerted on said element.

The module 14 is in contact with the liquid or gaseous fluid inside chamber 3 or circulating through the latter and is triggered when an upper threshold temperature is exceeded, releasing the opening 5 by moving the element 15 against the load of spring 12.

Regarding notably an application of the invention in the context of engine cooling, the secondary or outlet openings 5, 6 and 7 may be externally extended by respective end-pieces 5', 6' and 7' and the valve body 1' may have connecting points 22 or 29" on its external face around the primary or inlet opening 4.

The end-piece 5' may have a bearing 5" to hold and guide a part of the blocking element 15 or the thermal safety module 13.

The valve body 1' may be formed of one or a plurality of parts, of a thermoplastic or other material, by injection moulding of one piece or by joining a plurality of parts which have been separately injection-moulded.

According to a variation of the invention, shown in particular in FIGS. 7, 8, 9 and 12, the valve body 1' comprises two constituent parts joined together tightly, namely, a first main part 28 having a hollow substantially cylindrical overall structure, which has the inlet opening 4 and the secondary or radial outlet opening or openings 6, 7 and in which the throttle-chamber 2 is slidably mounted, and a second part 28' in the form of a lid or cover which closes one of the end openings of the first cylindrical constituent part 28 and which incorporates the secondary or axial outlet opening 5, as well as an end-piece 5' extending said opening 5 towards the exterior, the other end opening of the first constituent part 28 being blocked, at least partially, by the casing 11' of an actuator 11, allowing the movement in translation of the sliding throttle-chamber 2.

The two parts 28 and 28' which are tightly joined, for example by vibration fusing, thus forming the chamber 3.

Advantageously, the first main part 28 of the valve body 1' has a composite composition and comprises an internal cylindrical piece 29 forming a sliding guiding element for the first cylindrical part 8 of the throttle-chamber 2 and an external piece 29' forming the structural body and having exterior joining or connecting points 29", 29'" in the region of the inlet opening 4, for the secondary radial opening or openings 5, 6, 7 and for the end opening closed by the second part 28' in the form of a lid or cover, the external piece 29' preferably being over-moulded onto said internal piece 29 and said two pieces 29 and 29' having coincident cut-outs defining the aforementioned inlet and radial openings.

This composite composition of the valve body 1' results in an internal chamber 3 with very good cylindricity, enabling precise, smooth guidance without jamming, possibly aided by an appropriate choice of materials which have a low coefficient of friction and are resistant to wear (for example, PPS - polyphenylsiloxane). The over-moulding material forming the external body 29' preferably consists of a material of high mechanical strength which is inexpensive and easily injected (for example, polyamide which has possibly been reinforced).

The end-pieces 6', 7' may possibly, as shown in FIGS. 7, 8, 9, 10, 11 and 12, have connection interface portions 6", 7" the conformation of which allows a tight joint at additional points 29'" formed in the region of the radial openings 6, 7, for example by vibration fusing or adhesion.

The end-pieces 6', 7' may be separate (FIG. 7, 8, 12) or integral with a common connection interface portion 6", 7" (FIG. 9, 10, 11).

Moreover, the end-piece connections of other circuit portions may if necessary be incorporated into the connection interface portion 7" of the end-piece 7', thus allowing the formation of a circulation unit in the form of a complex piece 36 affixed to the valve body 1' and either incorporating or not incorporating the end-piece 6' (cf. FIG. 9 and 12).

Figure 11:
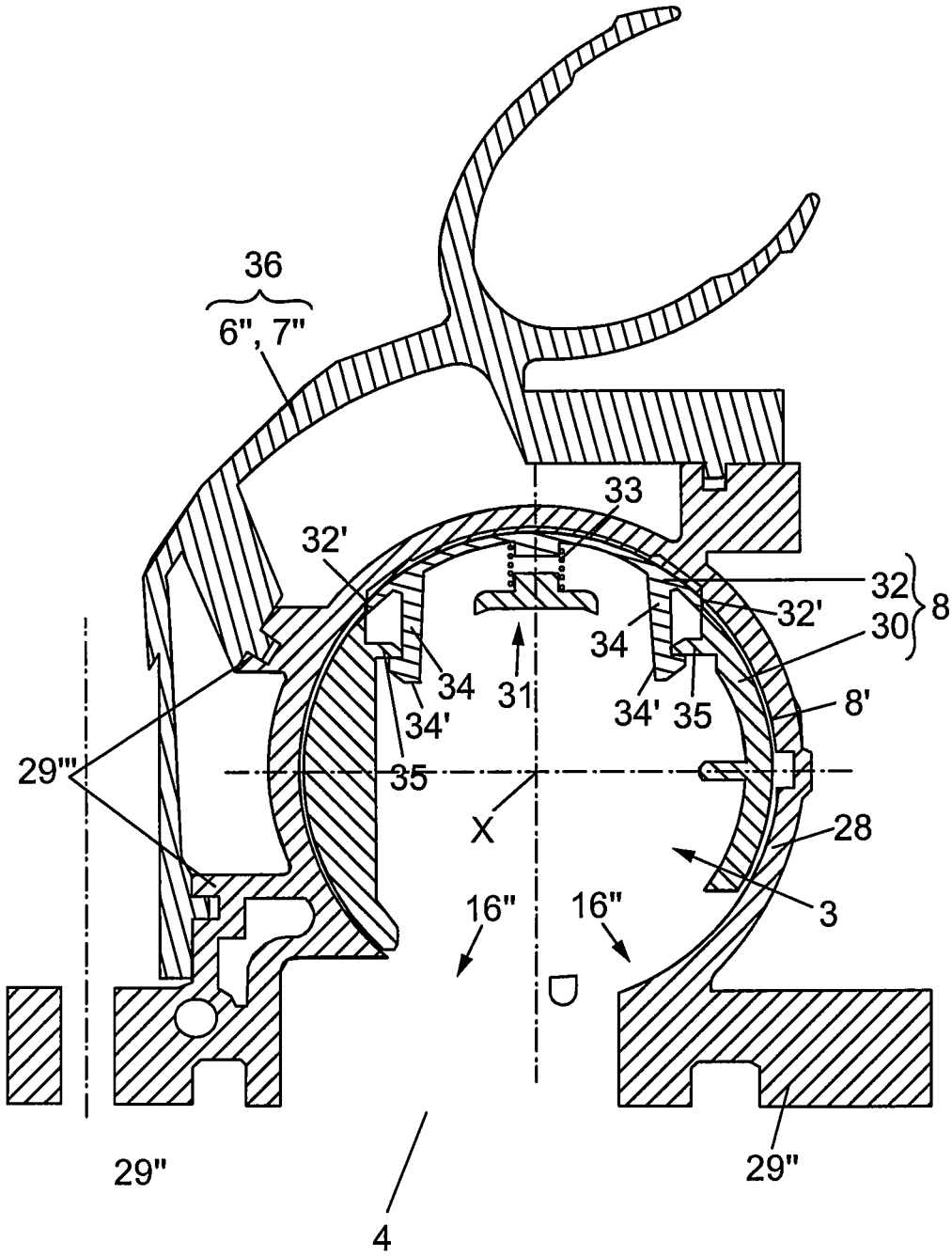
FIG. 11 is a cross-section identical to those shown in FIGS. 10A and 10B, to a different scale, showing a first part of throttle-chamber with a composite structure forming part of the valve unit as shown in FIGS. 7 to 10, and FIGS. 12A, 12B, 12C and 12D illustrate four consecutive stages of manufacture of a valve unit as shown in FIGS. 7 to 11.
Figures 12A, 12B, 12C, 12D:
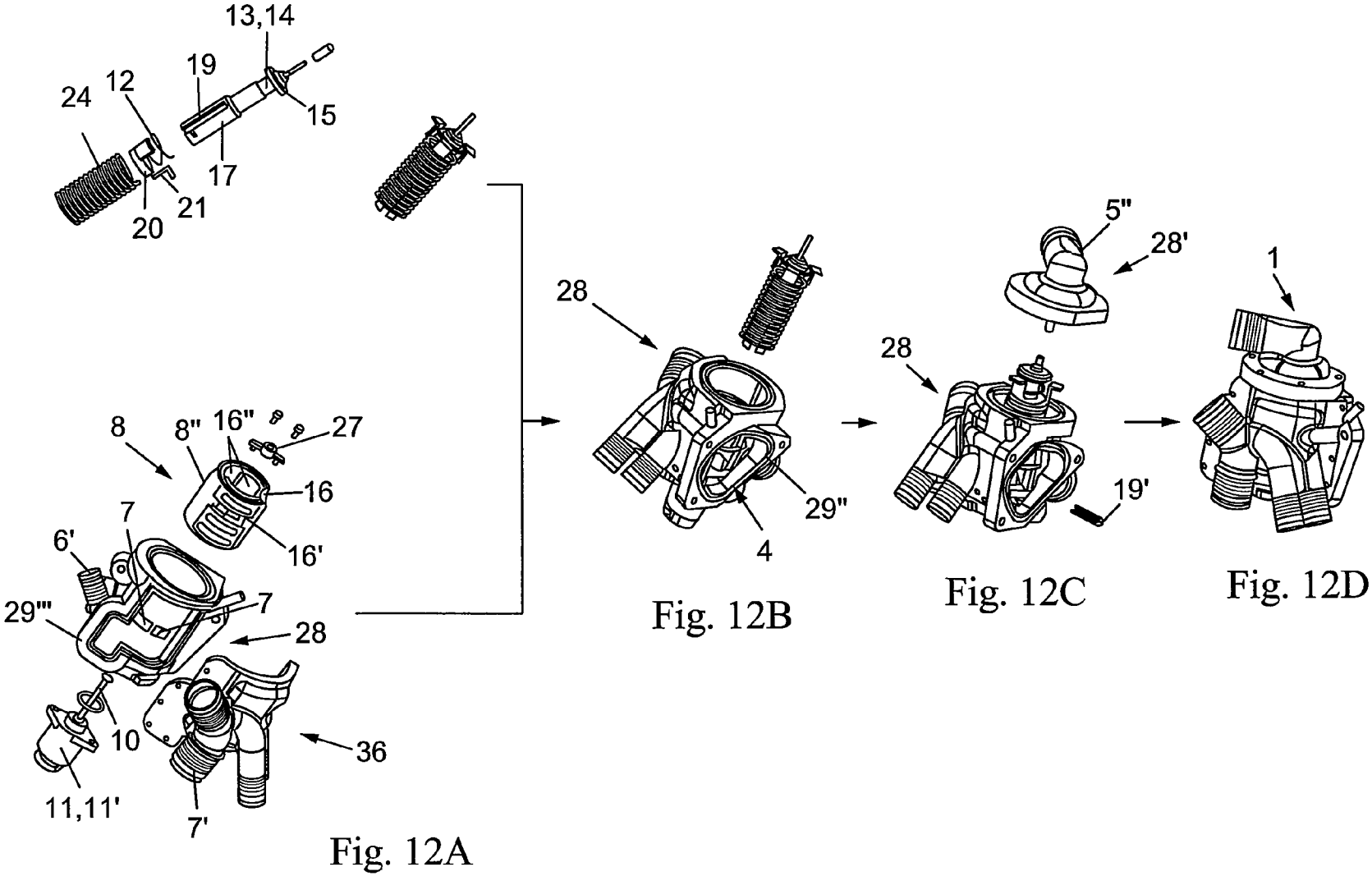

According to another characteristic of the invention, shown in particular in FIGS. 9 and 11, the first part 8 of the sliding throttle-chamber 2 consists of a composite piece 30, 32. This piece has a hollow cylindrical support structure 30 which can slide inside the chamber 3 of the valve body 1' and which basically consists of a perforated peripheral wall 8', of which a first aperture or a first series of apertures in the form of a cut-out or cut-outs 16" forms a travel opening and is to be positioned opposite the inlet opening 4 so as to allow communication between the latter and the chamber 3, whatever the translation position of the first part 8 of the throttle-chamber 2, and of which at least one other aperture 31 receives an insert 32 in the form of a curved plate with a cut-out 16, 16' to be brought opposite an outlet or secondary radial opening 6, 7 during the sliding travel of the first part 8 of the throttle-chamber 2 into the chamber 3 of the valve body 1'.

Advantageously, the or each curved plate forming an insert 32 is fitted movably into the perforated cylindrical support structure 30 by being loaded radially towards the exterior by the action of a resilient load, provided, for example by one or more compression springs 33, the said plate 32 being guided radially and held in the support structure 30 by corresponding co-operating means of said plate 32 and said support 30, so as to allow a limited protuberant extension of the exterior surface of said plate 32 beyond the cylindrical surface defined by the exterior surface of the wall 8' of said support structure 30.

This arrangement results in an improved seal in the region of the aforementioned cut-out 16 and/or 16' by permanent intimate contact between the corresponding plate and the internal face of the chamber 3.

According to a possible practical embodiment, shown in FIG. 11, the co-operating guidance and holding means for each plate 32 consist, for the one part, of a pair of shaped vanes 34 formed on the internal surface of said plate 32 and the free sides 34' of which are shaped into hooks and, for the other part, of internal projections 35 in the form of opposing fins of the support structure 30, the maximum extension position towards the exterior of the plate 32 being defined by the abutment of the hooks 34' of the vanes 34 of said plate 32 on said projections 35 and the radial movement of said plate 32 being guided by sliding support of said projections 35 on said vanes 34, and, if necessary, by lateral contact between the sides 32' of said plate 32 and the sides of the corresponding aperture 31 made in the wall 8' forming the support structure 30.

The invention also relates to a cooling circuit for an internal combustion engine, characterised in that it comprises a valve unit 1 as described above and illustrated in the accompanying drawings, the primary or inlet opening 4 of which is directly connected to the outlet or inlet of the cooling circuit portions integral with the engine block.

Advantageously, the secondary or axial outlet opening 5 is fluidly connected to a radiator, the first secondary or radial outlet opening 6 is connected fluidly to a unit heater and the second secondary or radial outlet opening 7 is connected fluidly to a by-pass circuit.

Finally, the invention also relates to a process for manufacturing a valve unit as previously described, in particular with reference to FIGS. 7 to 11.

This process, four main stages of which are shown in FIGS. 12A, 12B, 12C and 12D, basically consists in providing, in the form of a pre-assembled sub-unit, a second part 9 of throttle-chamber 2 comprising in particular a blocking element 15 mounted on an elongate driving body, a resilient means 12 and a stirrup having a support ring 20 and arms 21, as well as, if necessary, a second compression spring 24, in also providing the first and second parts 28 and 28' of the valve body 1', an actuating means 11 with a control rod 10 and a first part 8 of throttle-chamber 2, in fitting the first part 8 of the throttle-chamber into the first part 28 of the valve body 1' and the actuating means 11 thereon, in operationally joining the first part 8 of the throttle-chamber 2 to the control rod 10, in positioning the sub-unit forming the second part 9 of throttle-chamber 2 in the first part 8 and in joining the second part 28' of the valve body 1' to the first part 28 so as to tightly close the chamber 3, whilst achieving the locked positioning of the stirrup.

Moreover, the process may also consist in connecting at least some end-pieces 6', 7' extending the outlet or secondary radial opening or openings 6, 7 over the corresponding joining points 29", 29'" formed on the first part 28 of the valve body 1', before or after fitting the other components.

Clearly, the invention is not limited to the embodiments described and illustrated in the accompanying drawings. Modifications remain possible, in particular from the point of view of the composition of the various elements or by replacing them with technical equivalents, without departing from the scope of protection of the invention.

What is claimed is

1. A valve unit, comprising:

a valve body having a distribution chamber partly shaped and adapted to receive a sliding throttle-chamber moveable in a guided manner in a direction of a shaped extension of said distribution chamber, and the throttle-chamber being moveable between two opposed extreme translation positions, wherein the translation positions define ways of fluid communication between an inlet opening and at least three outlet openings that are formed in the valve body that can be selectively released and blocked by said throttle-chamber for directly controlling fluid communication between said inlet and said at least three outlet openings, one of said outlet openings opening axially into said distribution chamber and the other two outlet openings opening radially with respect to said distribution chamber and being radially arranged around said valve body, said inlet and said two outlet openings not being aligned along an axis of symmetry of said distribution chamber corresponding to the direction of the shaped extension of the chamber; and wherein said throttle-chamber has a composite structure including a first part for directly controlling fluid communication through only the two radial outlet openings, and the throttle-chamber further comprising a second part for directly controlling fluid communication through only the axial outlet opening, and wherein the first and second parts are linked together by a driving link comprising a non-driving area located between the two opposed extreme translation positions of said throttle-chamber , and said first and second parts being in a positive driving engagement through said link in order for the second part to release the one axial outlet opening.

2. A valve unit, according to claim 1, wherein:

the first part is arranged so that the inlet opening is in fluid communication with the distribution chamber between both of the two translation positions.

3. A valve unit, according to claim 1, wherein:

the movement in translation of the throttle-chamber from one position to the other, starting from a position corresponding to a total blocking of the three outlet openings, defines cooperation of the first and second parts of the throttle-chamber and wherein the following different states of fluid communication exist; (a) release of one radial outlet opening; (b) release of another radial outlet opening, and (c) release of an axial outlet opening while keeping at least one radial opening released.

4. A valve unit, as claimed in claim 1, wherein:

the second part of the throttle-chamber releases the axial outlet opening, and a first radial outlet opening of the at least three outlet openings stays released, and a second radial outlet opening of the at least three outlet openings is blocked.

5. A valve unit, as claimed in claim 1, wherein:

the first part of the throttle-chamber is connected to actuating means to cause its translation motion;

the second part of the throttle-chamber is resiliently loaded by a resilient means towards a position of blocking the axial outlet opening wherein when the throttle-chamber moves between the two positions, only the first part is moved during a first driving stage corresponding to the non-driving area of the connection between the two parts, and further wherein the second part is not moved in translation in order to release the axial outlet opening against the resilient means.

6. A valve unit, according to claim 1, wherein:

the second part of the throttle-chamber includes a thermal safety device having a sensitive part in contact with fluid in the distribution chamber, the thermal safety device releasing the axial outlet opening against a normal load when a blocking element of the second part unseats.

7. A valve unit according to claim 6, wherein:

said thermal safety device includes a wax cartridge module, bearing the blocking element of the second part of the throttle-chamber and fitted in a front portion of an elongated drive element, the wax cartridge module being oriented to move the blocking element away from its closed position, against the load exerted on the blocking element.

8. A valve unit as claimed in claim 1, wherein: the first part of the throttle-chamber has an external shape adapted to slide at least partially inside the distribution chamber between the two translation positions, and wherein the first part further comprises two cut-outs that are located opposite respectively from the two radial outlet openings during the motion in translation of the first part between the two positions, thereby defining different states of fluid communication with the distribution chamber.

9. A valve unit as claimed in 1, wherein:

the second part of the throttle-chamber includes a blocking element communicating with an elongated driving element connected by a translation drive link with the non-driving area, wherein a resilient means pushes the blocking element in the closed position against the axial outlet opening, and the elongated drive element extends into the first part of the throttle-chamber.

10. A valve unit as claimed in claim 9, wherein:

the resilient means comprises a compression spring mounted on a support ring located opposite the axial outlet opening and held by arms resting on internal walls of the distribution chamber opposite the axial outlet opening, wherein the support ring and the arms extend between the elongated drive element and a sleeve of the first part of the throttle-chamber.

11. A valve unit as claimed in claim 1, wherein:

the valve body includes said distribution chamber in which it is open on a side opposite a wall supporting the axial outlet opening, the open side of the distribution chamber being blocked by a casing of an actuator allowing translation motion of the throttle-chamber by means of a control rod, and the distribution chamber having a lateral recess forming a radial volume extension communicating with the inlet opening into said distribution chamber.

12. A valve unit according to claim 1, wherein:

the three outlet openings each communicate with respective end pieces that therefore extend the outlet openings, and further wherein the valve body has connecting points on its external face around an external extension of the inlet opening.

* * * * *